US006278418B1

(12) United States Patent
Doi

(10) Patent No.: US 6,278,418 B1
(45) **Date of Patent: *Aug. 21, 2001**

(54) THREE-DIMENSIONAL IMAGING SYSTEM, GAME DEVICE, METHOD FOR SAME AND RECORDING MEDIUM

(75) Inventor: Hideaki Doi, Tokyo (JP)

(73) Assignee: Kabushiki Kaisha Sega Enterprises, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/775,480

(22) Filed: Dec. 30, 1996

(30) Foreign Application Priority Data

Dec. 29, 1995 (JP) ..... 7-352529

(51) Int. Cl.[7] ..... G09G 5/00

(52) U.S. Cl. ..... 345/7; 345/8; 345/156

(58) Field of Search ..... 345/156, 157, 345/158, 145, 146, 7, 8; 463/34, 31, 44; 434/307; 395/326; 364/578

(56) References Cited

U.S. PATENT DOCUMENTS 4,988,981 * 1/1991 Zimmerman et al. ..... 345/158
5,590,062 * 12/1996 Nagamitsu et al. ..... 345/8
5,683,297 * 11/1997 Raviv et al. ..... 345/8

OTHER PUBLICATIONS

3 CAVES: VROOM featured three CAVEs in one place downloaded from the internet on Jul. 26, 1995.
Surround–Screen Projection–Based Virtual Reality: The Design and Implementation of the CAVE and CAVE Automatic Virtual Environment, Carolina Cruz–Neira, Electronic Visualization Laboratory (EVL), University of Illinois at Chicago, downloaded from the internet on Jul. 26, 1995.
About the Lab . . ., Electronic Visualization Laboratory, University of Illinois at Chicago downloaded off of the internet on Jul. 26, 1996.
The CAVE: A Virtual Reality Theater, Electronic Visualization Laboratory, University of Illinois at Chicago HPCCV Publications Issue 2, downloaded off of the internet at http://www.ncsa.uiuc.edu/evl/html/CAVE.html.
CAVE Research: Scope of Work, Electronic Visualization Laboratory, University of Illinois at Chicago HPCCV Publications Issue 2.

(List continued on next page.)

*Primary Examiner*—Xiao Wu
(74) *Attorney, Agent, or Firm*—Morrison & Foerster LLP

(57) ABSTRACT

A three-dimensional imaging system provides an image display system, a method and a recording medium, whereby a three-dimensional display of virtual images causes an observer to perceive virtual images three-dimensionally at a part of the body, such as the hand, of the observer. The system includes, for example, a position detecting unit detecting unit detecting the position in real space of a prescribed part of the body of an observer viewing the virtual images, and outputs the spatial coordinates thereof. A display position determining unit determining unit determines the positions at which the observer is caused to perceive the virtual images, on the basis of ages, on the basis of the spatial coordinates output by the position detecting unit.

30 Claims, 14 Drawing Sheets

OTHER PUBLICATIONS

CAVE Applications Development, Electronic Visualization Laboratory, University of Illinois at Chicago HPCCV Publications Issue 2, downloaded off of the internet on Jul. 26, 1995.

CAVE References, Electronic Visualization Laboratory, University of Illinois at Chicago HPCCV Publications Issue 2, downloaded off of the internet on Jul. 26, 1995.

CAVE Acknowlegdements, Electronic Visualization Laboratory, University of Illinois at Chicago HPCCV Publications Issue 2, downloaded off of the internet on Jul. 26, 1995.

CAVE User'Guide, Electronic Visualization Laboratory, University of Illinois at Chicago Sep. 29, 1994, downloaded off of the internet on Jul. 26, 1995.

Surround–Screen Projection–Based Virtual Reality: The Design and Implementation of the CAVE, COMPUTER GRAPHICS Proceedings, Annual Conference Series, 1993, by Carolina Cruiz–Neira, et al., in the University of Illinois at Chicago.

* cited by examiner

PLAYER 1
PLAYER 2
S1
S2
S3
S4
S5
S6
S7
S8
T1
T2
T3
T4
T5
T6
T7
T8
AR1
AR2
AR3
AR4
AR5
AR6
AR7
AR8
AT
201
202
203
204
205
206
207
208
210
211
serial buffer
2 TRANSCEIVER DEVICE
GL1
GL2
3 INFRA-RED TRANSMITTER
1 PROCESSING DEVICE
IMAGE PROCESSING
101
VOICE PROCESSING
102
MIDI
103
MIDI
104
MIXER
105
TRANSMITTER
106
TRANSMITTER
107
HP1
HP2
108
109
AMPLIFIER
110
111
112
113
114
4a
4b
4e
4f
401
402
403
404
DISPLAY (LEFT)
CIRCUIT (RIGHT)
FRAME BUFFER
PROJECTION TUBE

THREE-DIMENSIONAL IMAGING SYSTEM, GAME DEVICE, METHOD FOR SAME AND RECORDING MEDIUM

BACKGROUND OF THE INVENTION

1. Field of the Invention

The present invention relates to a three-dimensional imaging system, and in particular, it relates to improvements in three-dimensional image display technology for presenting so-called three-dimensional images to a plurality of people.

2. Description of the Related Art

Image display devices, which display images over a plurality of image display screens, have been developed. For example, in Japanese Laid-Open Patent Application 60-89209, and Japanese Laid-Open Patent Application 60-154287, and the like, image display devices capable of displaying common images simultaneously on a plurality of image display screens (multi-screen), are disclosed. In these image display devices, a large memory space is divided up by the number of screens, and the image in each divided memory area is displayed on the corresponding screen.

Furthermore, with the progress in recent years of display technology based on virtual reality (VR), three-dimensional display devices for presenting observers with a sensation of virtual reality over a plurality of image display screens, have appeared. A representative example of this is the CAVE (Cave Automatic Virtual Environment) developed in 1992 at the Electronic Vizualization Laboratory at the University of Illinois, in Chicago, U.S.A. Using a projector, the CAVE produces three-dimensional images inside a space by displaying two-dimensional images on display screens located respectively in front of the observers, on the left- and right-hand walls, and on the floor, to a size of approximately 3 m square. An observer entering the CAVE theatre is provided with goggles operated by liquid crystal shutters. To create a three-dimensional image, an image for the right eye and an image for the left eye are displayed alternately at each vertical synchronization cycle. If the timing of the opening and closing of the liquid crystal shutters in the goggles worn by the observer is synchronized with the switching timing of this three-dimensional image, then the right eye will be supplied only with the image for the right eye, and the left eye will be supplied only with the image for the left eye, and therefore, the observer will be able to gain a three-dimensional sensation when viewing the image.

In order to generate a three-dimensional image, a particular observer viewpoint must be specified. In the CAVE, one of the observers is provided with goggles carrying a sensor for detecting the location of the observer's viewpoint. Based on viewpoint coordinates obtained via this sensor, a computer applies a matrix calculation to original image data, and generates a three-dimensional image which is displayed on each of the wall surfaces, and the like.

The CAVE theatre was disclosed at the 1992 ACM SIGGRAPH conference, and a summary has also been presented on the Internet. Furthermore, detailed technological summaries of the CAVE have been printed in a paper in "COMPUTER GRAPHICS Proceedings, Annual Conference Series, 1993", entitled "Surround-Screen Projection-Based Virtual Reality: The Design and Implementation of the CAVE" (Carolina Cruz-Neira and two others).

SUMMARY OF THE INVENTION

If a three-dimensional imaging system is used in a game device, or the like, a case may be imagined where the observer (player) attacks characters displayed as three-dimensional images. In this case, if a virtual image of a weapon, or the like, which does not exist in real space, can be displayed in the observer's hands, and furthermore, if virtual images of bullets, light rays, or the like, can be fired at the characters, then it is possible to stimulate the observer's interest to a high degree.

Further, by displaying the virtual image of the weapon in the observer's hand, the weapon which fits the atmosphere of the game can be displayed in a moment: in the game featuring travel through history, the weapon which fits any era can be displayed whichever era the game shows.

Therefore, it is an object of the present invention to provide a three-dimensional imaging system, game device, method for same, and a recording medium, whereby virtual images can be displayed three-dimensionally at a part of the body, such as a hand, or the like, of an observer.

In a three-dimensional imaging system which causes an observer to perceive virtual images three-dimensionally, a three-dimensional imaging system comprises:

position detecting means for detecting the position in real space of a prescribed part of the observer viewing said virtual images, and outputting the spatial coordinates thereof; and display position determining means for determining the positions at which the observer is caused to perceive said virtual images, on the basis of spatial coordinates output by said position detecting means.

In a three-dimensional imaging system which respectively supplies virtual images to the eyes of an observer, accounting for parallax therein, thereby causing the observer to perceive these virtual images three-dimensionally, a three-dimensional imaging system characterized in that it comprises:

position detecting means for detecting the position in real space of a prescribed part of the observer of said virtual images, and outputting the spatial coordinates thereof; and image display means for displaying said virtual images on the basis of the spatial coordinates output by said position detecting means, such that images are formed at positions corresponding to said spatial coordinates.

In a three-dimensional imaging system according to claim 1, a three-dimensional imaging system characterized in that said virtual images include images of objects which are perceived by the observer to be fired from the position detected by said position detecting means.

In a three-dimensional imaging system according to claim 2, a three-dimensional imaging system characterized in that said virtual images include images of objects which are perceived by the observer to be fired from the position detected by said position detecting means.

In a three-dimensional imaging system according to claims 1, a three-dimensional imaging system characterized in that it comprises impact determining means for determining, on the basis of spatial coordinates for a first virtual image and spatial coordinates for a second virtual image, whether or not an impact occurs between said first virtual image and said second virtual image.

In a three-dimensional imaging system according to claims 2, a three-dimensional imaging system characterized in that it comprises impact determining means for determining, on the basis of spatial coordinates for a first virtual image and spatial coordinates for a second virtual image, whether or not an impact occurs between said first virtual image and said second virtual image.

In a three-dimensional imaging system according to claims 3, a three-dimensional imaging system characterized in that it comprises impact determining means for determining, on the basis of spatial coordinates for a first virtual image and spatial coordinates for a second virtual image, whether or not an impact occurs between said first virtual image and said second virtual image.

In a three-dimensional imaging system according to claims 4, a three-dimensional imaging system characterized in that it comprises impact determining means for determining, on the basis of spatial coordinates for a first virtual image and spatial coordinates for a second virtual image, whether or not an impact occurs between said first virtual image and said second virtual image.

In a three-dimensional imaging system according to claim 5, a three-dimensional imaging system characterized in that said impact determining means determines whether or not said impact occurs by calculating whether or not there is any overlapping between one or more spatial regions having a prescribed radius set by said first virtual image, and one or more spatial regions having a prescribed radius set by said second virtual image, on the basis of said radii.

In a three-dimensional imaging system according to claim 6, a three-dimensional imaging system characterized in that said impact determining means determines whether or not said impact occurs by calculating whether or not there is any overlapping between one or more spatial regions having a prescribed radius set by said first virtual image, and one or more spatial regions having a prescribed radius set by said second virtual image, on the basis of said radii.

In a three-dimensional imaging system according to claim 7, a three-dimensional imaging system characterized in that said impact determining means determines whether or not said impact occurs by calculating whether or not there is any overlapping between one or more spatial regions having a prescribed radius set by said first virtual image, and one or more spatial regions having a prescribed radius set by said second virtual image on the basis of said radii.

In a three-dimensional imaging system according to claim 8, a three-dimensional imaging system characterized in that said impact determining means determines whether or not said impact occurs by calculating whether or not there is any overlapping between one or more spatial regions having a prescribed radius set by said first virtual image, and one or more spatial regions having a prescribed radius set by said second virtual image, on the basis of said radii.

In a three-dimensional imaging system according to claim 1, a three-dimensional imaging system characterized in that said virtual images are formed by displaying alternately images corresponding to a left eye viewpoint, and images corresponding to a right eye viewpoint, and using electronic shutters which open and close in synchronization with this, images corresponding to said left eye viewpoint and images corresponding to said right eye viewpoint are supplied independently to the left and right eyes of the observer, thereby causing this observer to perceive said virtual images.

In a three-dimensional imaging system according to claim 2, a three-dimensional imaging system characterized in that said virtual images are formed by displaying alternately images corresponding to a left eye viewpoint, and images corresponding to a right eye viewpoint, and using electronic shutters which open and close in synchronization with this, images corresponding to said left eye viewpoint and images corresponding to said right eye viewpoint are supplied independently to the left and right eyes of the observer, thereby causing this observer to perceive said virtual images.

In a three-dimensional imaging system according to claim 2, a three-dimensional imaging system characterized in that said image display means comprises screens onto which images from projectors, or the like, provided at at least one of the walls surrounding the observation position of said images, are projected.

In a game device comprising a three-dimensional imaging system according to claim 1, a game device characterized in that said virtual images are displayed as images for a game.

In a game device comprising a three-dimensional imaging system according to claim 2, a game device characterized in that said virtual images are displayed as images for a game.

In a three-dimensional image display method for displaying virtual images three-dimensionally in real space, a three-dimensional image display method characterized in that it determines:

a step whereby the position in real space of a prescribed part of an observer of said virtual images is detected;

a step whereby the spatial coordinates thereof are output; and a step whereby the display positions in real space of said virtual images are determined on the basis of said spatial coordinates.

In a three-dimensional imaging method which respectively supplies virtual images to the eyes of an observer, accounting for parallax therein, thereby enabling the observer to perceive these virtual images three-dimensionally, a three-dimensional image display method comprises:

a step whereby the position in real space of a prescribed part of the observer of said virtual images is detected;

a step whereby the spatial coordinates thereof are output; and a step whereby said virtual images are displayed on the basis of said spatial coordinates, such that images are formed at positions corresponding to said spatial coordinates.

In a three-dimensional image display method according to claim 18, a three-dimensional imaging method characterized in that said virtual images include images of objects which are perceived by the observer to be fired from the position detected by said position detecting means.

In a three-dimensional image display method according to claim 19, a three-dimensional imaging method characterized in that said virtual images include images of objects which are perceived by the observer to be fired from the position detected by said position detecting means.

A recording medium, wherein a procedure for causing a processing device to implement the three-dimensional image display method according to claims 18, is stored.

A recording medium, wherein a procedure for causing a processing device to implement the three-dimensional image display method according to claims 19, is stored.

A recording medium, wherein a procedure for causing a processing device to implement the three-dimensional image display method according to claims 20, is stored.

A recording medium, wherein a procedure for causing a processing device to implement the three-dimensional image display method according to claims 21, is stored.

DESCRIPTION OF THE PREFERRED EMBODIMENTS

Below, modes for implementing the present invention are described with reference to the appropriate drawings.

(I) First Mode

The first mode for implementing the present invention relates to an image display device for supplying three-dimensional images simultaneously to two players and conducting playing of a game.

(Overall composition)

Figure 1:
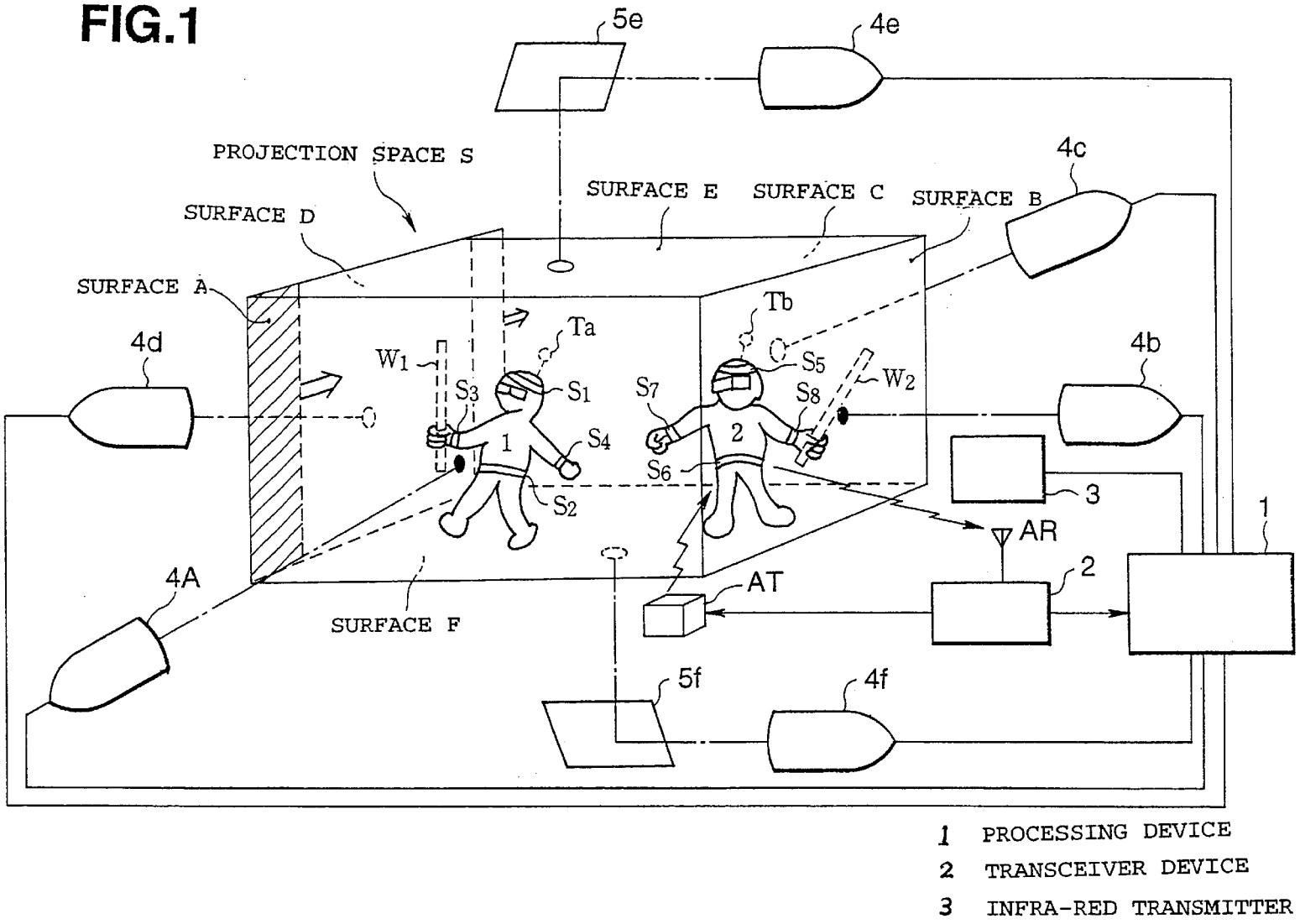
FIG. 1 is a general oblique view describing an image display device according to a first mode of the present invention.

FIG. 1 shows the overall composition of an image display device in the present mode. As shown in FIG. 1, a projection space S for an image display device according to the present mode is surrounded by six surfaces. Three-dimensional images are projected using each of the four sides (labelled surface A–surface D in the drawing), the ceiling (labelled surface E) and the floor (labelled surface F), which form this projection space, as image display surfaces. Each image display surface should be of suitable strength, and should be made from a material which allows images to be displayed by transmitting light, or the like. For example, chloride plastic, or glass formed with a semi-transparent coating, or the like, may be used. However, if the surface is one which it is assumed the players will not touch, such as surface E forming the ceiling, then a projection screen, or the like, may be used.

The image display surfaces may be formed in any shape, provided that this shape allows the projector to display images on the front thereof. However, in order to simplify calculation in the processing device, and to simplify correction of keystoning or pincushioning produced at the edges of the display surfaces, it is most desirable to form the surfaces in a square shape.

Figure 2:
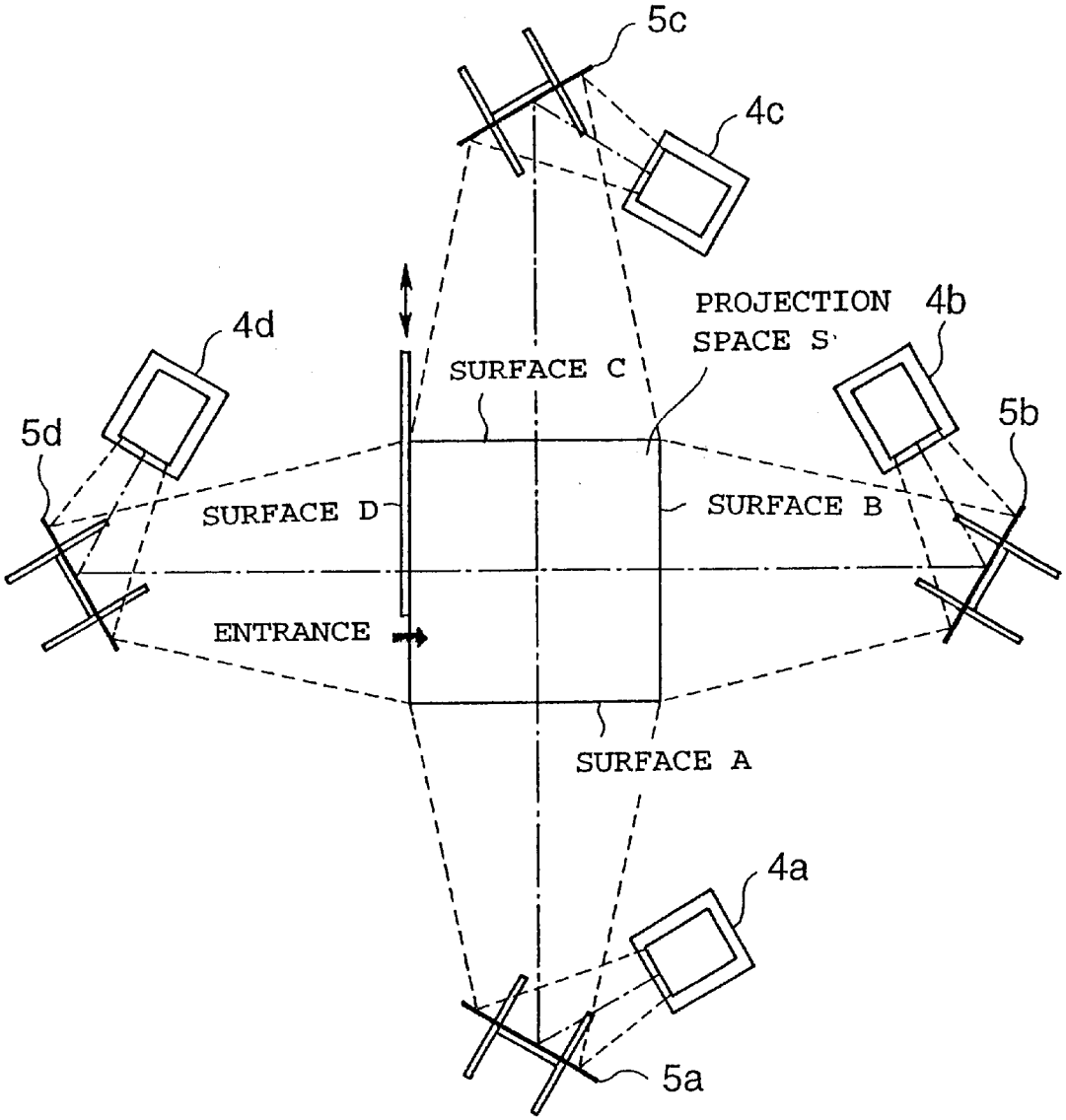
FIG. 2 is a front view showing a projection space and the location of a projector according to the first mode.

Any one of the surfaces, (in the present embodiment, surface A,) is formed by a screen which can be opened and closed by sliding. Therefore, it is possible for the observers to enter into the projection space, S, by opening surface A in the direction of the arrow in FIG. 1 (see FIG. 2 also.) During projection, a complete three-dimensional image space can be formed by closing surface A.

For the sake of convenience, the observers will be called player 1 and player 2. Each player wears sensors which respectively transmit detection signals in order to specify the player's position. For example, in the present mode, a sensor $S_1$ ($S_5$) is attached to the region of player 1's (or player 2's) goggles, a sensor $S_2$ ($S_6$), to the player's stomach region, and sensors $S_3$, $S_4$ ($S_7$, $S_8$), to both of the player's arms. Each of these sensors delect a magnetic field from a reference magnetic field antenna AT, and output detection signals corresponding to this in the form of digital data. Furthermore, whilst each sensor may output the intensity of the magnetic field independently, as in the present mode, it is also possible to collect the detection signals of each sensor at a fixed point and to transmit them in the form of digital data from a single antenna. For example, as shown by dotted lines in FIG. 1, the detection signals may be collected at a transmitter provided on the head of each player, and then transmitted from an antenna, Ta or Tb.

Projectors 4*a*–4*f* each project three-dimensional images onto one of the wall surfaces. The projectors 4*a*–4*f* respectively display three-dimensional images on surface A–surface F. Reflecting mirrors 5*a*–5*f* are provided between each of the projectors and the image display surfaces (see FIG. 2 also). These reflecting mirrors are advantageous for reducing the overall size of the system.

Processing device 1 is a device forming the nucleus of the present image display device, and it is described in detail later. A transceiver device 2 supplies a current for generating a reference magnetic field to the reference magnetic field antenna AT, whilst also receiving detection signals from the sensors $S_1$–$S_8$ attached to player 1 and player 2. The reference magnetic field antenna AT is located in a prescribed position on the perimeter of the projection space S, for example, in a corner behind surface F, or at the geometrical color of surface F. It is desirable for it to be positioned such that when each sensor has converted the strength of the magnetic field generated by this reference magnetic field antenna AT to a current, the size of the current value directly indicates the relative position of the sensor. An infra-red communications device 3 transmits opening and closing signals to the goggles equipped with liquid crystal shutters worn by each player.

(Connection structure)

Figure 3:
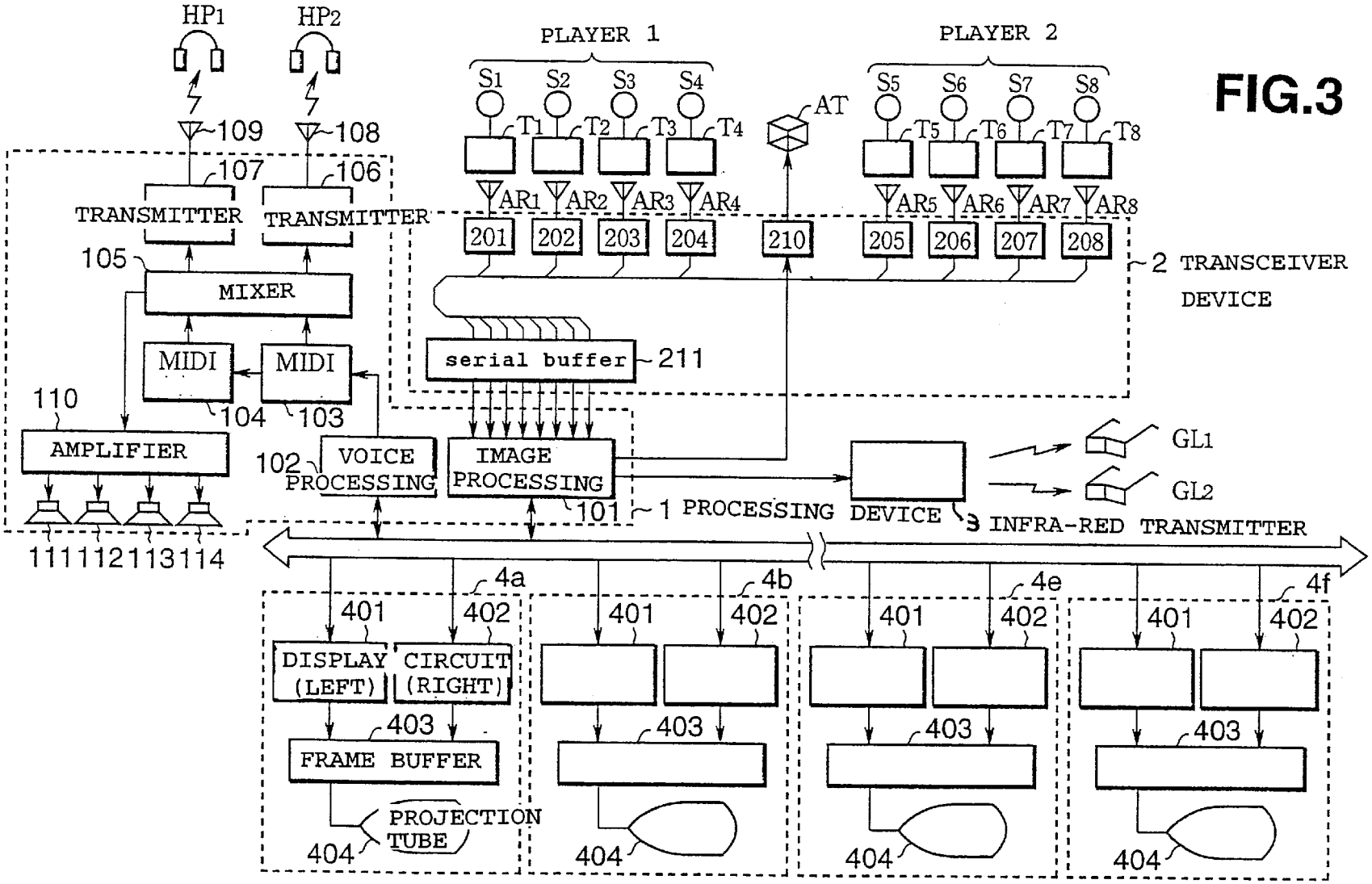
FIG. 3 is a block diagram showing connection relationships in the first mode.

FIG. 3 shows a block diagram illustrating the connection relationships in the first mode. Classified broadly, the image processing device of the present mode comprises: a processing device 1 forming the main unit for image and sound processing, a transceiver device 2 which generates a reference magnetic field and receives detection signals from each player, an infra-red transmitter 3 which transmits opening and closing signals for the goggles fitted with liquid crystal shutters, and the respective projectors 4*a*–4*f*.

Player 1 is provided with sensors $S_1$–$S_4$ and transmitters $T_1$–$T_4$ which digitally transmit the detection signals from each of these sensors, and player 2 is provided with sensors $S_5$–$S_8$ and transmitters $T_5$–$T_8$ which digitally transmit the detection signals from each of these sensors. The sensors may be of any construction, provided that they output detection signals corresponding to the electromagnetic field intensity. For example, if a sensor is constituted by a plurality of coils, then each sensor $S_1$–$S_8$ will detect the magnetic field generated by the reference magnetic field antenna AT and will converted this to a current corresponding to the detected magnetic field intensity. Each transmitter $T_1$–$T_8$, after converting the size of this current to digital data in the form of a parameter indicating the intensity of the magnetic field, then transmits this data digitally to the transceiver device 2. This is because the current detected by each sensor is very weak and is liable to be affected by noise, and therefore, if it is converted to digital data immediately after detection, correct detection values can be supplied to the processing device 1 in an unaffected state. There are no particular restrictions on the frequency or modulation system used for transmission, but steps are implemented whereby, for example, a different transmission frequency is used for the detection signal from each sensor, such that there is no interference therebetween. Furthermore, the positions of the players' viewpoints can be detected by means of sensors $S_1$ and $S_4$ located on the goggles worn by the users, alone. The other sensors are necessary for discovering the attitude of the users and the positions of different parts of the users' bodies, for the purpose of determining impacts, as described later.

The transceiver device 2 comprises a reference magnetic field generator 210 which causes a reference magnetic field to be generated from the reference magnetic field antenna AT, receivers 201–208 for receiving, via antennae AR1–AR8, the digitally transmitted detection signals from sensors $S_1$–$S_8$, and a serial buffer 211 for storing the detection signals from each of the receivers.

Under the control of the image processing block 101, the reference magnetic field generator 210 outputs a signal having a constant current value, for example, a signal wherein pulses are output at a prescribed cycle. The reference magnetic field antenna AT consists of electric wires of equal length formed into a box-shaped frame, for example. Since all the adjoining edges intersect at right angles, at positions more than a certain distance away from the antenna, the detected intensity of the magnetic field will correlate to the relative distance from the antenna. If a signal having a constant current value is passed through this antenna, a reference magnetic field of constant intensity is generated. In the present embodiment, distance is detected by means of a magnetic field, but distance detection based on an electric field, or distance detection using ultrasonic waves, or the like, may also be used.

Each of the receivers 201–208 transfers the digitally transmitted detection signals from each of the sensors to the serial buffer. The serial buffer 211 stores the serial data transferred from each receiver in a bi-directional RAM (dual-port RAM).

The processing device 1 comprises: an image processing block 101 for conducting the principal calculational operations for image processing, a sound processing block 102 for conducting sound processing, a MIDI sound source 103 and an auxiliary sound source 104 for generating sounds based on MIDI signals output by the sound processing block 102, a mixer 105 for synthesizing the sounds from the MIDI sound sources 103 and 104, transmitters 106 and 107 for transmitting the sound from the mixer 105 to headphones HP1 and HP2 worn by each of the players, by frequency modulation, or the like, an amplifier 110 for amplifying the sound from the mixer 105, speakers 111–114 for creating sounds for monitors in the space, and transmission antennae 108, 109.

The image processing block 101 is required to have a computing capacity whereby picture element units for three-dimensional images can be calculated, these calculations being carried out in real time at ultra-high speed. For this purpose, the image processing block 101 is generally constituted by work stations capable of conducting high-end full-color pixel calculations. One work station is used for each image display surface. Therefore, six work stations are used for displaying images on all the surfaces, surface A–surface F. In a case where the number of picture elements is 1280×512 pixels, for example, each work station is required to have an image processing capacity of 120 frames per second. One example of a work station which satisfies these specifications is a high-end machine (trade name "Onyx") produced by Silicon Graphics. Each work station is equipped with a graphics engine for image processing. It may use, for example, a graphics library produced by Silicon Graphics. The image data generated by each work station is transferred to each of the projectors 4*a*–4*f* via a communications line. Each of the six work stations constituting the image processing block 101 transfers its image data to the projector which is to display the corresponding image.

The infra-red transmitter 3 modulates opening and closing signals supplied by the image processing block 101, at a prescribed frequency, and illuminates an infra-red diode, or the like. The goggles, GL1 and GL2, fitted with liquid crystal shutters, which are worn by each player, detect the infra-red modulated opening and closing signals by means of light-receiving elements, such as photosensors, or the like, and demodulate them into the original opening and closing signals. The opening and closing signals contain information relating to timings which specify the opening period for the right eye and the opening period for the left eye, and therefore the goggles, GL1 and GL2, fitted with liquid crystal shutters, open and close the liquid crystal shutters in synchronization with these timings. The infra-red communication should be configured in accordance with a standard remote controller. Furthermore, a different communication method may be used in place of infra-red communication, provided that it is capable of indicating accurate opening and closing timings for the left and right eyes.

Each of the projectors 4*a*–4*f* is of the same composition. A display circuit 401 reads out an image for the right eye from the image data supplied from the image processing block 101, and stores it in a frame buffer 403. A display circuit 402 reads out an image for the left eye from the image data supplied from the image processing block 101, and stores it in a frame buffer 403. A projection tube 404 displays the image data in the order in which it is stored in the frame buffer 403. The light emitted from the projection tube 404 is projected onto an image display surface of the projection space S. The projectors 4*a*–4*f* may be devised such that they conduct image display on the basis of standard television signals, but in the present mode, it is desirable for the frequency of the reference synchronizing signal to be higher than the frequency in a standard television system, in order that the vertical synchronization period in the display can be further divided. For example, supposing that the vertical synchronization frequency is set to 120 Hz, then even if the vertical synchronization period is divided in two to provide image display periods for the left and right eyes, images are shown to each eye at a cycle of 60 Hz, and therefore, flashing or flickering are prevented and high image quality can be maintained. Furthermore, the number of picture elements is taken as 1280×512 pixels, for example. This is because the number of picture elements in a standard television format does not provide satisfactory resolution for large screen display.

(Description of Action)

Figure 4:
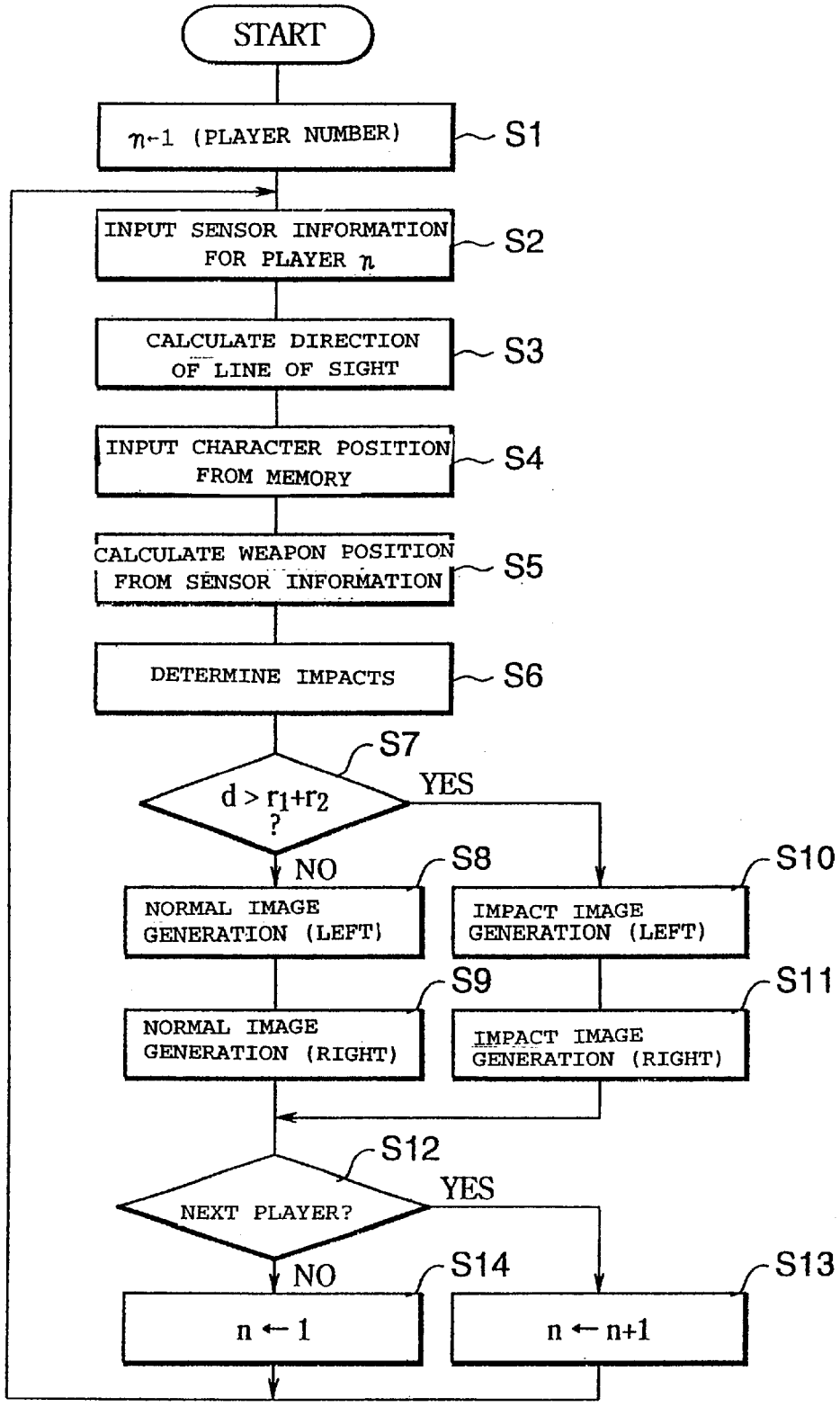
FIG. 4 is a flowchart describing the operation of an image display device according to the first mode.

Next, the action of the first mode is described. FIG. 4 shows a flowchart describing the action of this mode.

It is assumed that each of the work stations forming the image processing block 101 accesses a game program from a high-capacity memory, and implements continuous read-out of said program and original image data corresponding to this program. The players enter the projection space by opening surface A which forms an entrance and exit. Once it is confirmed that the players are inside, surface A is closed and the processing device 1 implements a game program.

Firstly, a counter for counting the number of players is set to an initial value (step S1). In the present mode, there are two players, so n=2. Detection signals corresponding to the movement of each player around the projection space S are input to the transceiver device 2 from the sensors $S_1$–$S_8$, and are stored successively in the serial buffer 211.

The image processing block 101 reads out the detection signals for player 1 from the buffer (step S2). In this, the data from sensor $S_1$ located on the goggles is recognized as the detection signal for detecting the viewpoint. Furthermore, the detection signals from the other sensors $S_2$–$S_4$ are held for the subsequent process of determining impacts (step $S_6$).

Figure 5:
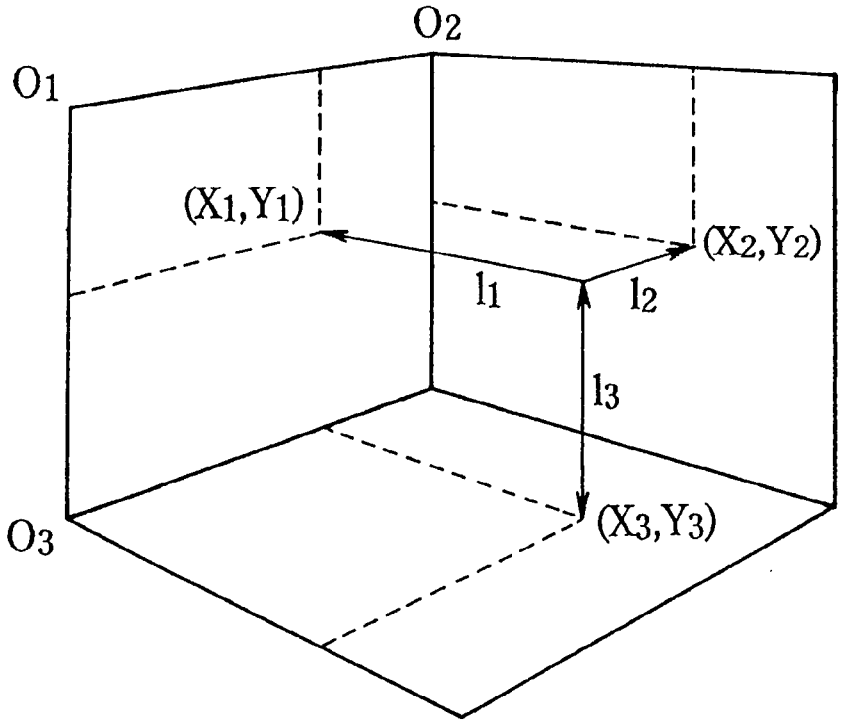
FIG. 5 is an explanatory diagram of viewpoint detection in the projection space.

In step $S_3$, the viewpoint and line of sight of player 1 are calculated on the basis of the detection signal from sensor $S_1$. FIG. 5 shows an explanatory diagram of viewpoint calculation. The detection signal from sensor $S_1$ indicates the positional coordinates of the viewpoint of player 1. In other words, assuming that the projection space S is square in shape, and the coordinates of its color are (x,y,z)=(0,0,0), then relative coordinates from this color can be determined by adding or subtracting an offset value to the digital data indicated by the detection signals. By determining these relative coordinates, as shown in FIG. 5, it is possible to derive the distance of the point forming the viewpoint from each surface, and the resulting coordinates when it is directed at any of the surfaces. Furthermore, as regards the direction of the player's line of sight, a method may be applied, whereby, for example, the direction in which the player's face is pointing (in the following description, the direction of the player's face is assumed to be the same as the direction of the player's viewline) is detected by means of coordinates' calculation: the processing device 1 receives signals which indicate a location or an angle from sensors of the glass 1 or 2, and calculates the locating information and angular information towards a standard magnetic field. Since the goggles point in front of the player's face, it may also be determined that the direction in which the detection signal from the sensor on the goggles can be detected, is the direction in which the player's face is pointing. On the basis of these parameters and the direction of the line of sight, the work stations calculate coordinate conversions for each pixel in the original image data, whilst referring to a graphics library. This calculation is conducted in order from the right eye image to the left eye image.

Figure 6:
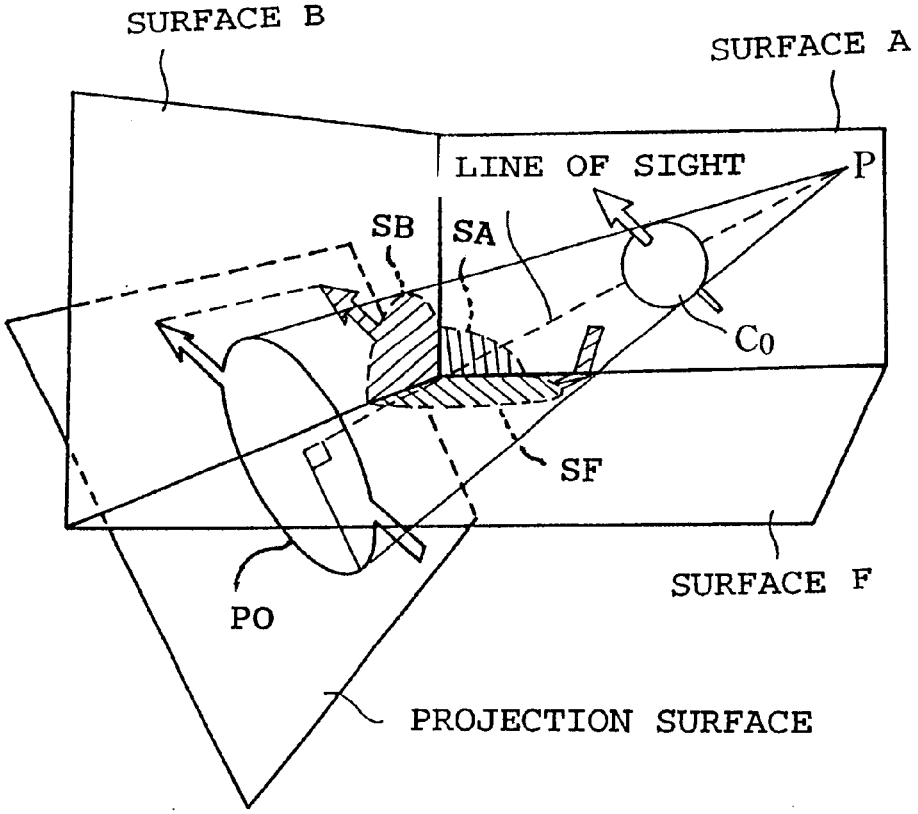
FIG. 6 is a diagram describing the relationship between a viewpoint in the projection space, a virtual image, and a display image.

FIG. 6 shows the relationship between a three-dimensional image and the data actually displayed on each of the image display surfaces. In FIG. 6, $C_0$ indicates the shape and position of a virtual object which is to be perceived as a three-dimensional image. By determining the viewpoint P and the direction of the line of sight indicated by the dotted line in the diagram, the projection surface (which is set for calculation only) onto which the virtual object is to be projected can be determined. The shapes of the sections (SA, SB and SF) formed where each image display surface (in FIG. 6, surface A, surface B and surface F) cuts the projection PO on its path to this projection surface, represent the images that are actually to be displayed on each image display surface. With regard to the details of the matrix calculation for converting the original image data to the shapes of the aforementioned sections, for example, the CAVE technology described in the section on the "Related Art" may be applied. If accurate calculation is conducted, it is possible to generate a three-dimensional image which can be perceived as a virtual object by the player, without the player being aware of the border lines between surface A, surface B and surface F in FIG. 6. In step S3, the viewpoint alone is specified, and the actual coordinate conversions of the original image data are calculated in steps S8–S11.

(Action for determining impacts)

Steps S4–S7 relate to determining impacts. This is described with reference to FIG. 7. For example, in a case where a dinosaur is displayed as a character which is the object of attack by the players, the character is displayed such that an image is perceived in the spatial position shown by label C in FIG. 7. Meanwhile, the image processing block 101 refers to the detection signals from the sensors attached to the players' hands, and displays a weapon as an image which is perceived at the spatial position of one of the players' hands. For example, a three-dimensional image is generated such that, when viewed by player 1, a weapon W is present at the position of the player's right hand. As a result, player 1 perceives the presence, in his/her own hand, of a weapon W that does not actually exist, and player 2 also perceives that player 1 is holding a weapon W.

In step S4, the image processing block 101 sets balls, $CB_1$, $CB_2$, for determining impacts. These balls are displayed not as real images but as a mathematical image for calculation. Furthermore, in step S5, it sets a number of balls $WB_1$, $WB_2$, along the length of the weapon W. These balls serve to simplify the process of determining impacts. Balls are set according to the size of the dinosaur forming the object of attack, such that they virtually cover the whole body of the character.

Figure 8:
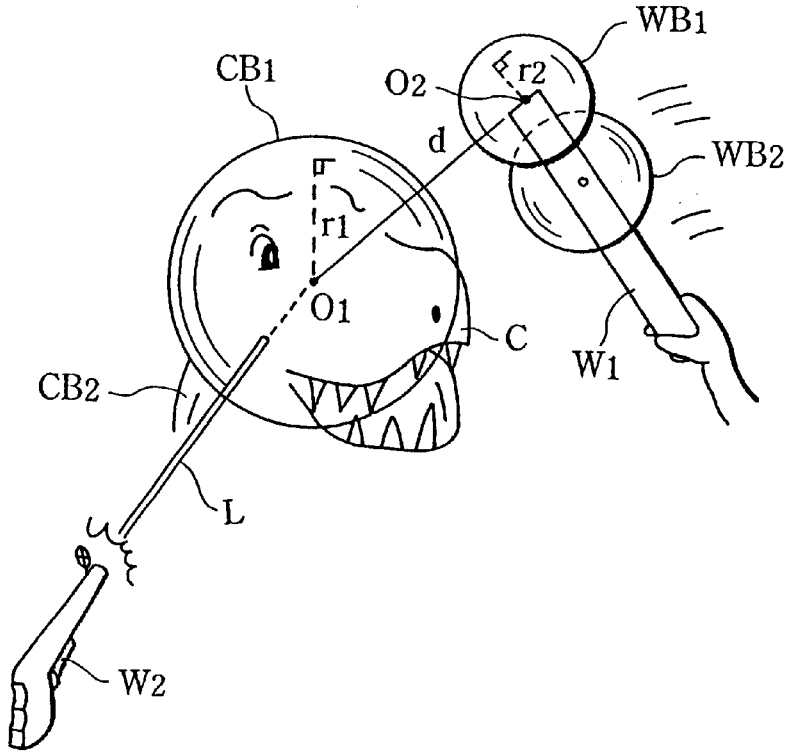
FIG. 8 is an explanatory diagram of impact determination.

As shown in FIG. 8, the image processing block 101 identifies the radius and the central coordinates of each ball as the parameters for specifying the balls. In FIG. 8, the central point of ball $CB_1$ on the dinosaur side is taken as $O_1$ and its radius, as $r_1$, and the central point of ball $WB_1$ on the weapon side is taken as $O_2$, and its radius, as $r_2$. If the central points of two balls are known, the distance, d, between their respective central points can be found. Therefore, by comparing the calculated distance, d, and the sum of the radii, $r_1$ and $r_2$, of the two balls, it can be determined whether or not there is an impact between the weapon $W_1$ and the dinosaur C (step S7). This method is applicable not only to determining impacts between the weapon W1 and the dinosaur C, but also to determining impacts between a laser beam, L, fired from a ray gun, $W_2$, and the dinosaur C. Furthermore, it can also be used for determining impacts between the players and the object of attack. The ray gun $W_2$ can be displayed as a virtual image, but it is also possible to use a model gun which is actually held by the player. If a sensor for positional detection is attached to the barrel of the ray gun $W_2$, a three-dimensional image, wherein a laser beam is emitted from the region of the gun barrel, can be generated, and this can be achieved by the same approach as that used to display weapon $W_1$ at the spatial position of the player's hand.

If distance d is greater than the sum of the radii of the two balls, ($d>r_1+r_2$) (step S7; NO), in other words, if it is determined that the weapon W has not struck the dinosaur C, then three-dimensional image generation is conducted in the order of right eye image (step S8) followed by left eye image (step S9), using the standard original image data. If distance d is smaller than the sum of the radii of the two balls, ($d \leqq R_1+r_2$) (step S7; YES), in other words, if it is determined that the weapon W has struck the dinosaur C, then explosion image data for an impact is read out along with the standard original image data, and these data are synthesized, whereupon coordinate conversion is carried out (step S10, S11).

If a further player is present (step S12; YES), in other words, if player 2 is present in addition to player 1, as in the present mode, the player counter is incremented (step S13). If no further players are present (step S12; NO), the player counter is reset (step S14).

The processing described above concerned an example where virtual images of a dinosaur forming the object of attack, weapons, and a laser beam fired from a ray gun, are generated, but if original image data is provided, other virtual images may also be generated. For example, if an original image is prepared of a vehicle in which the players are to ride, then despite the fact that the players are simply standing (or sitting on a chair), it is possible to generate an image whereby, in visual terms, the players are aboard a flying object travelling freely through space.

The description here has related to image processing alone, but needless to say, stereo sounds corresponding to the progression of the images are supplied via the speakers 111–114.

(Action relating to shutter timing)

Figure 9:
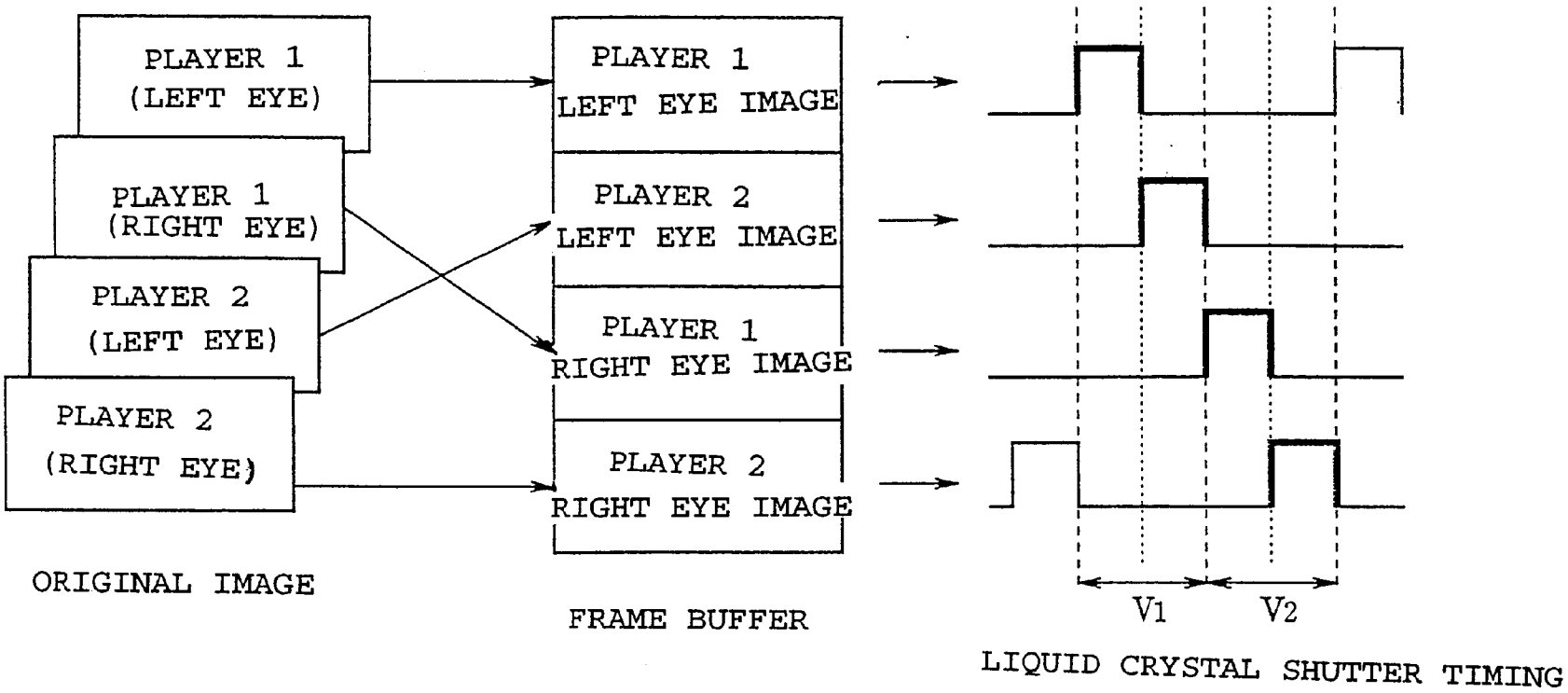
FIG. 9 is an explanatory diagram of the contents of a frame buffer, and liquid crystal shutter timings, in the first mode.

FIG. 9 is a diagram describing how the image processing block 101 is transferred and the form of the shutter timings by which it is controlled. Each element of original image data is divided into a left eye image display period V1, and a right eye image display period V2. Each image display period is further divided according to the number of players. In the present mode, this means dividing by two. In other words, the number of frame images in a single three-dimensional image is twice the number of players, n×2 (both eyes).

The image processing block 101 transfers image data to the projectors 4*a*–4*f*, in frame units. As shown in FIG. 9, the work stations transfer images to each player in the order of left eye image followed by right eye image. For example, the left eye display circuit 401 in the projector 4 stores left eye image data for player 1 in the initial block of the frame buffer 403. The right eye display circuit 402 stores the right eye image data for player 1, which is transferred subsequently, in the third block of the frame buffer 403. Similarly, the left eye image data for player 2 is stored in the second block of the frame buffer 403, and the right eye image data is stored in the fourth block.

The frame buffer 403 transmits image data from each frame in the order of the blocks in the buffer. In synchronization with this transmission timing, the image processing block 101 supplies opening and closing signals for driving the liquid crystal shutters on the goggles worn by the players, via the infra-red transmitter 3 to the goggles. At player 1's goggles, the left eye assumes an open state when the image data in the initial block in the frame buffer 403 is transmitted, and an opening signal causing the right eye to assume an open state is output when the image data in the third block is transmitted. Similarly, at player 2's goggles, the left eye assumes an open state when the image data in the second block in the frame buffer 403 is transmitted, and an opening signal causing the right eye to assume an open state is output when the image data in the fourth block is output.

Each player sees the image with the left eye only, when a left eye image based on the player's own viewpoint is displayed on the image display surfaces, and each player sees the image with the right eye only, when a right eye image is displayed. When the image for the other player is being displayed, the shutters over both eyes are closed. By means of the action described above, each player perceives a three-dimensional image which generates a complete sense of virtual reality from the player's own viewpoint.

As can be seen from FIG. 9, each image display surface switches successively between displaying images for the right and left eyes for each player, on the basis of the same original image data. Therefore, assuming that the lowest frequency at which a moving picture can be observed by the human eye without flickering is 30 Hz, it can be seen that the frequency of the synchronizing signal for transfer of the frame images must be multiplied by the number of players, n×2 (both eyes).

Figure 7:
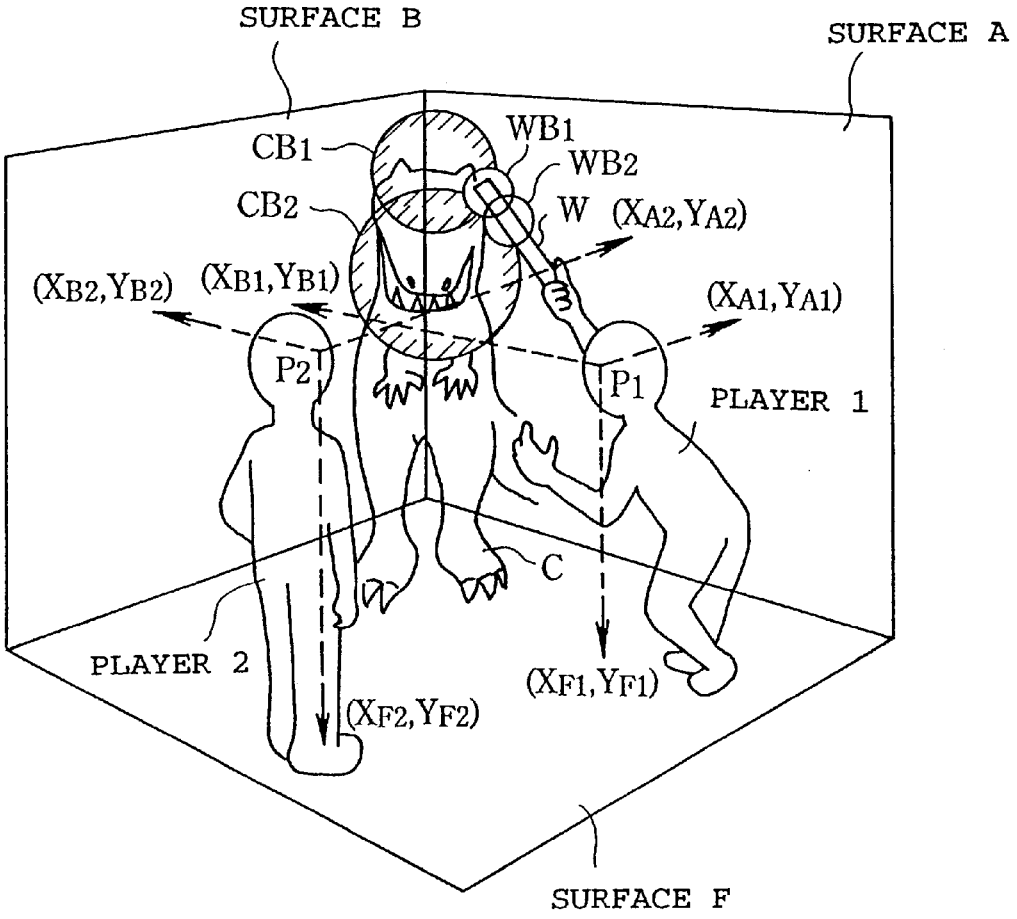
FIG. 7 is an explanatory diagram of an object of attack displayed in the first mode.
Figure 10:
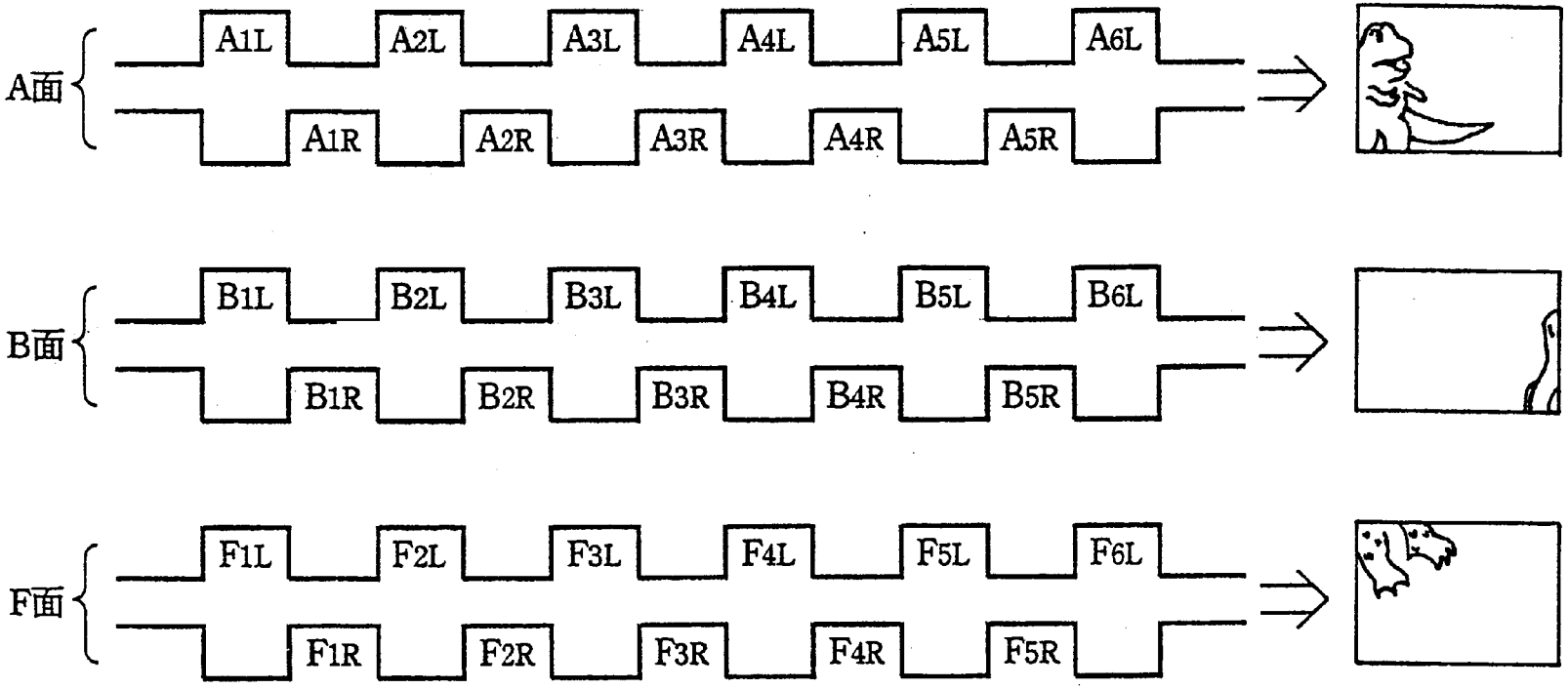
FIG. 10 is a diagram of the relationship between image display surfaces and shutter timings.

FIG. 10 shows the display timings for each of the surfaces, surface A, surface B and surface F, on which the virtual image illustrated in FIG. 7 is displayed, and the appearance of the images actually displayed. Specifically, within the period for completing one three-dimensional image, during the first half of the period, the liquid crystal shutter for the left eye opens, and during the second half of the period, the liquid crystal shutter for the right eye opens. Thereby, each player perceives a three-dimensional image on the image display surfaces.

(Merits of the Present Mode)

The merits of the present mode according to the composition described above are as follows.

i) Since images are displayed on six surfaces, it is possible for a player to experience a game with a complete sensation of virtual reality.

ii) Since players can enter and leave by opening an image display surface, there is no impairment of the three-dimensional images due to door knobs, or the like.

iii) Since high-end work stations conduct the image processing, it is possible to display three-dimensional images having a high-quality sensation of speed.

iv) Since impacts are determined by a simple method, it is possible to identify whether or not there is any impact between virtual images, or between a virtual image and a real object or part of a player's body, thereby increasing the appeal of the game.

v) Since the vertical synchronization frequency is high, three-dimensional images which are free of flickering can be observed.

(II) Second Mode

A second mode of the present invention relates to a device for displaying three-dimensional images simultaneously to three or more people, in a composition according to the first mode.

The composition of the image display device according to the present mode is approximately similar to the first mode. However, the frequency for displaying each frame image is higher than in the first mode. Specifically, in the present mode, if the number of people playing is taken as n, then the frequency of the synchronizing signal acting as the transmission timing for the frame images is equal to the frequency of the synchronizing signal for displaying a single three-dimensional image multiplied by twice the number of players, n×2 (both eyes). In this, the work stations are required to be capable of processing image data for each frame at a processing frequency of 60 Hz×n.

Figure 11:
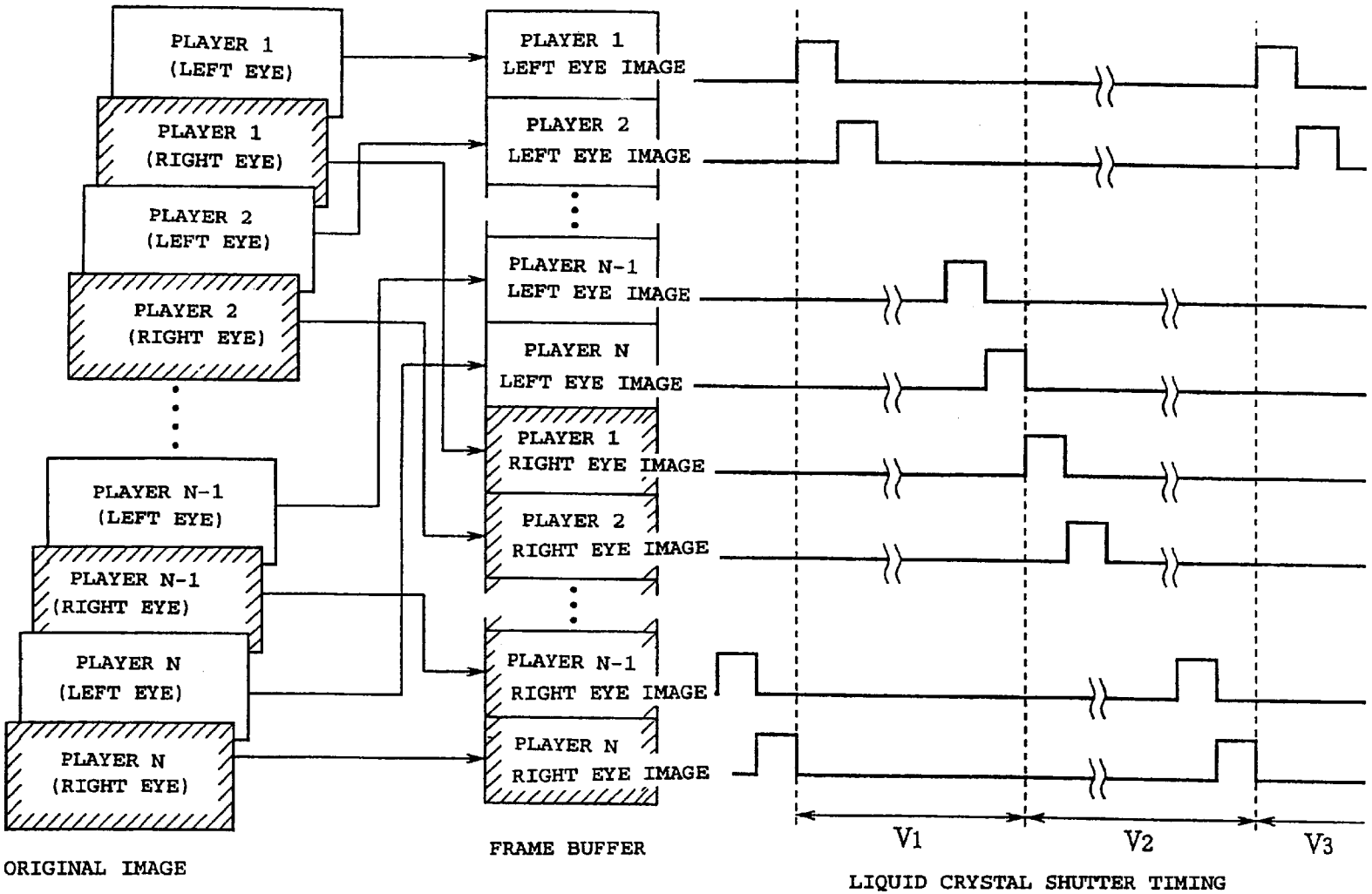
FIG. 11 is an explanatory diagram of the contents of a frame buffer, and liquid crystal shutter timing, in a second mode of the present invention.

FIG. 11 shows the relationship between an original image in the second mode and the liquid crystal shutter timings. Although the number of players is n, the same approach as that described in FIG. 9 in the first mode should be adopted. In other words, the work station derives viewpoints for the n players from the single original image data, and generates left eye image data and right eye image data corresponding to each viewpoint. The projector arranges this image data within the frame buffer 403, and displays it in the order shown in FIG. 11, the liquid crystal shutters being opened and closed by means of opening and closing signals synchronized to this.

According to the second mode, a merit is obtained in that it is possible to display complete three-dimensional images to a plurality of people.

(Embodiment)

FIG. 12–FIG. 14 show embodiments of three-dimensional images which can be generated in the modes described above.

Figure 12A:
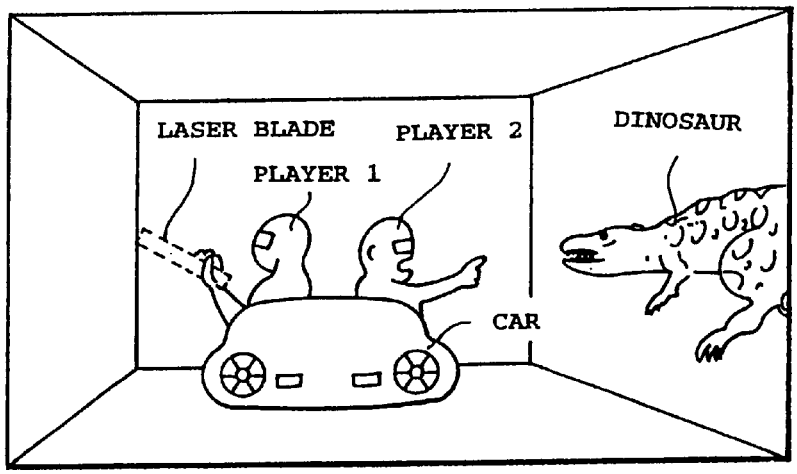
FIG. 12 is a first embodiment of three-dimensional images.

FIG. 12 is an embodiment of the game forming the theme in the first mode. FIG. 12(A) depicts a scene where a dinosaur appears at the start of the game. The "car" is a virtual object generated by virtual images, and player 1 and player 2 sense that they are riding in the car. Furthermore, player 1 is holding a laser blade which forms a weapon. As described above, this laser blade is also imaginary.

Figure 12B:
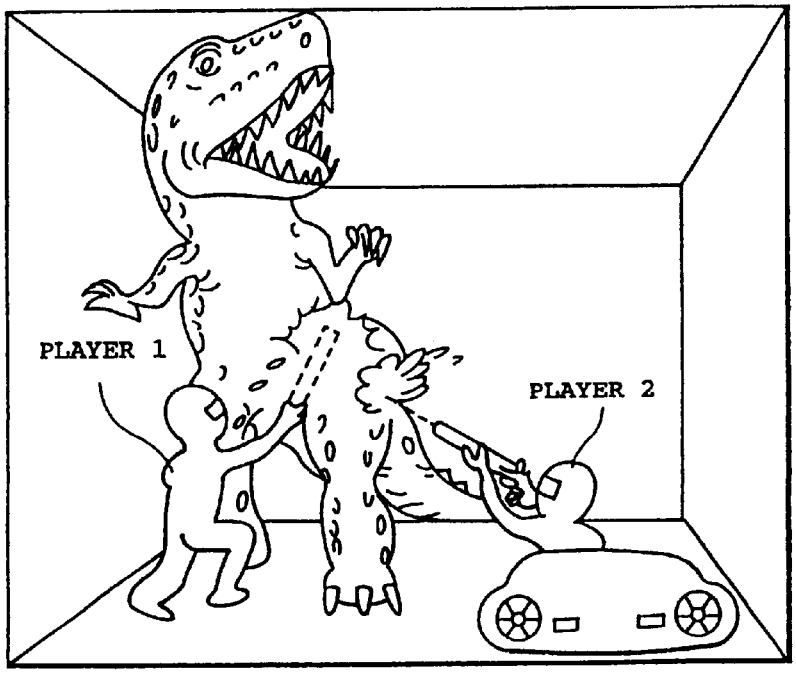

FIG. 12(B) depicts a scene where the dinosaur has approached and an actual fight is occurring. Impacts are determined as described in the first mode, and a battle is conducted between the players and the dinosaur. The ray gun held by player 2 is a model gun, and the laser beam fired from its barrel is a virtual image.

Figure 13A:
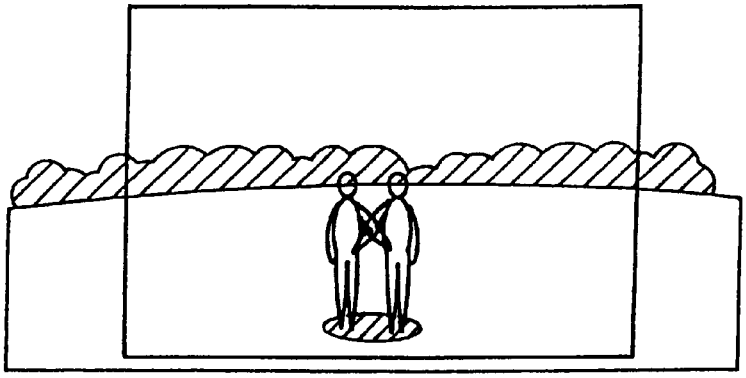
FIG. 13 is a second embodiment of three-dimensional images (part 1)
Figure 13B:
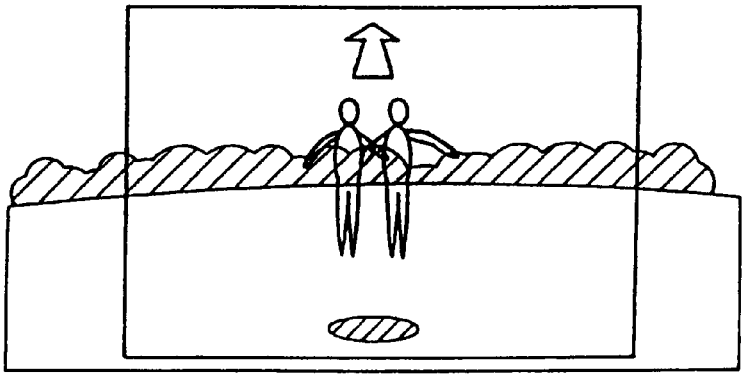
Figure 13C:
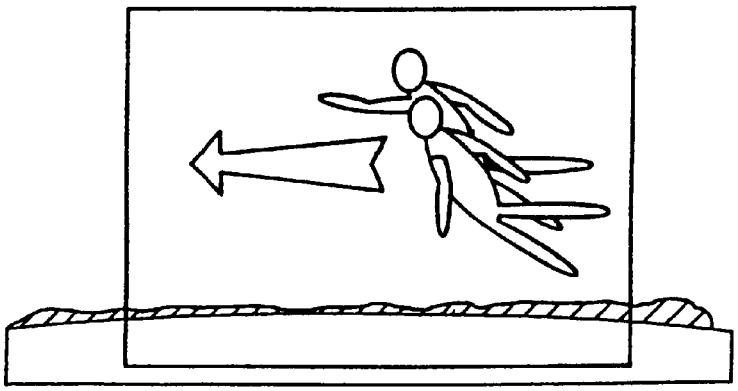

FIG. 13 and FIG. 14 show effective image developments for the openings of games or simulators, for example. In FIG. 13(A), two observers are standing in the middle of a room. Around them, virtual images of fields and a forest are displayed. In FIG. 13(B), the horizon created by the virtual images is lowered. As a result, the observers feel as though their bodies are floating. In FIG. 13(C), the scenery moves in a horizontal direction. Hence, the observers feel as though they are both flying.

Figure 14D:
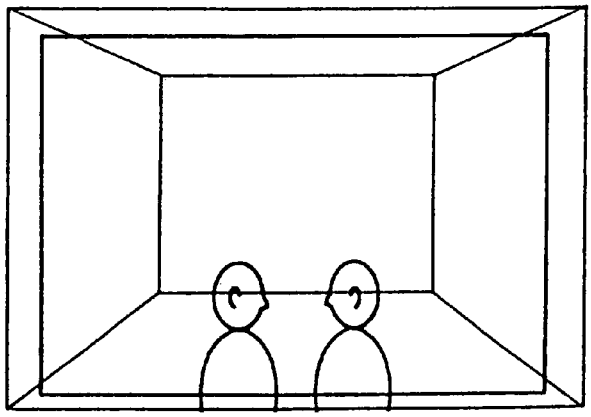
FIG. 14 is a second embodiment of a three-dimensional images (part 2).
Figure 14E:
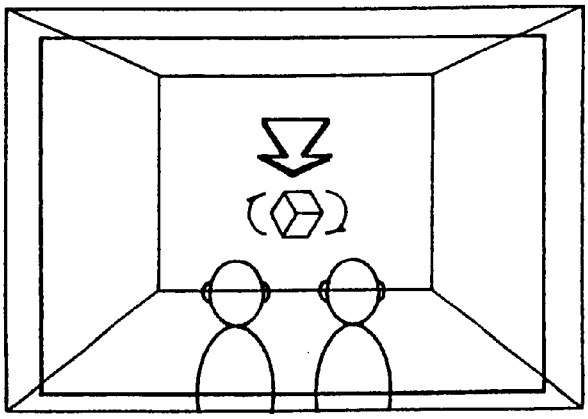
Figure 14F:
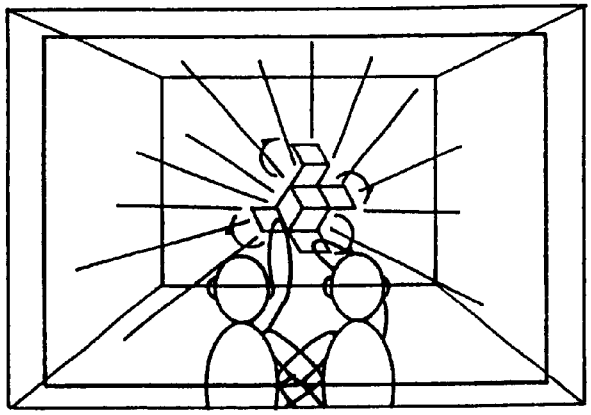

FIG. 14 shows an example of image development for a different opening. From an empty space as shown in FIG. 14(D), a rotating cube as depicted in FIG. 14(E) appears in front of the observers' eyes, accompanied by sounds. Here, impacts are determined as described in the first mode. Specifically, the occurrence of impacts between the virtual image of the cube and the hands of the observers fitted with sensors, are determined. Both of the observers reach out and try to touch the cube. When it is judged, from the relationship between the spatial positions of the two people's hands and the spatial position of the cube, that both people's hands have touched (struck) the cube, as shown in FIG. 14(F), the cube opens up with a discharge of light and the display moves on to the next development. In this example, it is interesting to set up the display such that the cube does not open up unless it is determined that both observers' hands have struck the cube.

As described above, according to the present invention, the viewpoints of each observer are specified, three-dimensional images are generated on the basis of the specified viewpoints, and each of the generated three-dimensional images are displayed by time division, and therefore each observer viewing the three-dimensional images in synchronization with this time division is able to perceive accurate three-dimensional images and feel a complete sense of virtual reality.

Furthermore, according to the present invention, since virtual images are displayed whereby it appears that a weapon, or the like, is present at a part of the body (for example, the hand) of an observer, and images are displayed such that virtual bullets, laser beams, or the like, are fired from this weapon, or the like, then it is applicable to a game which involves a battle using these items. Moreover, if impacts between virtual images, such as the dinosaur, and objects such as bullets, or the like, are identified, then it is possible to determine whether or not the bullets, or the like, strike an object.

What is claimed is:

1. A three-dimensional imaging system causing an observer to perceive virtual images three-dimensionally, comprising:

a position detecting device detecting the position, in real space, of a prescribed part of the observer viewing said virtual images, and outputting spatial coordinates;

a display position determining device determining the positions at which the observer is caused to perceive said virtual images, on the basis of the spatial coordinates output by said position detecting device, wherein the virtual images interact with and are controlled by the prescribed part; and a screen surrounding a game space such that the observer can perceive the images displayed on the screen three-dimensionally.

2. The three-dimensional imaging system according to claim 1, wherein said virtual images include images of objects which are perceived by the observer to be fired from the position detected by said position detecting device.

3. The three-dimensional imaging system according to claim 1, further comprising an impact determining device determining, on the basis of spatial coordinates for a first virtual image and spatial coordinates for a second virtual image, whether an impact occurs between said first virtual image and said second virtual image.

4. The three-dimensional imaging system according to claim 2, further comprising an impact determining device determining, on the basis of spatial coordinates for a first virtual image and spatial coordinates for a second virtual image, whether an impact occurs between said first virtual image and said second virtual image.

5. The three-dimensional imaging system according to claim 3, wherein said impact determining device determines whether said impact occurs by calculating whether there is any overlapping between one or more spatial regions having a prescribed radius set by said first virtual image, and one or more spatial regions having a prescribed radius set by said second virtual image, on the basis of said radii.

6. The three-dimensional imaging system according to claim 4, wherein said impact determining device determines whether said impact occurs by calculating whether there is any overlapping between one or more spatial regions having a prescribed radius set by said first virtual image, and one ore more spatial regions having a prescribed radius set by said second virtual image, on the basis of said radii.

7. The three-dimensional imaging system according to claim 1, wherein said virtual images are formed by alternately displaying images corresponding to a left eye viewpoint, and images corresponding to a right eye viewpoint, and using electronic shutters which open and close in synchronization, images corresponding to said left eye viewpoint and images corresponding to said right eye viewpoint are supplied independently to the left and right eyes of the observer, causing the observer to perceive said virtual images.

8. The three-dimensional imaging system according to claim 1, wherein the three-dimensional system is a game device displaying said virtual images displaying as images for a game.

9. A three-dimensional imaging system which respectively supplies virtual images to the eyes of an observer, accounting for parallax therein, causing the observer to perceive the virtual images three-dimensionally, comprising:

a position detecting device detecting the position, in real space, of a prescribed part of the observer of said virtual images, and outputting spatial coordinates;

an image display device displaying said virtual images on the basis of the spatial coordinates output by said position detecting device, such that the virtual images are formed at positions corresponding to the spatial coordinates, wherein the virtual images interact with and are controlled by the prescribed part; and a screen surrounding a game space such that the observer can perceive the images displayed on the screen three-dimensionally.

10. The three-dimensional imaging system according to claim 9, wherein said virtual images include images of objects which are perceived by the observer to be fired from the position detected by said position detecting device.

11. The three-dimensional imaging system according to claim 9, further comprising an impact determining device determining, on the basis of spatial coordinates for a first virtual image and spatial coordinates for a second virtual image, whether an impact occurs between said first virtual image and said second virtual image.

12. The three-dimensional imaging system according to claims 10, further comprising an impact determining device determining, on the basis of spatial coordinates for a first virtual image and spatial coordinates for a second virtual image, whether an impact occurs between said first virtual image and said second virtual image.

13. The three-dimensional imaging system according to claim 11, wherein said impact determining device determines whether said impact occurs by calculating whether there is any overlapping between one or more spatial regions having a prescribed radius set by said first virtual image, and one or more spatial regions having a prescribed radius set by said second virtual image, on the basis of said radii.

14. The three-dimensional imaging system according to claim 12, wherein said impact determining device determines whether said impact occurs by calculating whether there is any overlapping between one or more spatial regions having a prescribed radius set by said first virtual image, and one or more spatial regions having a prescribed radius set by said second virtual image, on the basis of said radii.

15. The three-dimensional imaging system according to claim 9, wherein said virtual images are formed by alternately displaying images corresponding to a left eye viewpoint, and images corresponding to a right eye viewpoint, and using electronic shutters which open and close in synchronization, images corresponding to said left eye viewpoint and images corresponding to said right eye viewpoint are supplied independently to the left and right eyes of the observer, causing the observer to perceive said virtual images.

16. The three-dimensional imaging system according to claim 9, said image display device further comprises screens onto which images are provided on at least one of the walls surrounding the observation position of said images.

17. The three-dimensional imaging system according to claim 9, wherein the three-dimensional imaging system is a game device displaying said virtual images as images for a game.

18. A three-dimensional image display method for displaying virtual images three-dimensionally in real space, comprising:

detecting a position in real space of a prescribed part of an observer of said virtual images;

outputting spatial coordinates of the position;

determining, on the basis of said spatial coordinates, display positions in real space of said virtual images, wherein the virtual images interact with and are controlled by the prescribed part; and displaying the images on a screen surrounding a game space such that the observer perceives the images three-dimensionally.

19. The three-dimensional image display method according to claim 18, further comprising perceiving said virtual images to include images of objects to be fired from the detected position.

20. A three-dimensional imaging method which respectively supplies virtual images to the eyes of an observer, accounting for parallax therein, enabling the observer to perceive the virtual images three-dimensionally, comprising:

detecting a position in real space of a prescribed part of the observer of said virtual images;

outputting spatial coordinates of the position; and displaying said virtual images, on the basis of said spatial coordinates, such that the virtual images are formed at positions corresponding to said spatial coordinates and the virtual images are displayed on a screen surrounding a games space such that the observer perceives the virtual images three-dimensionally, wherein the virtual images interact with and are controlled by the prescribed part.

21. The three-dimensional image display method according to claim 20, further comprising perceiving said virtual images to include images of objects to be fired from the detected position.

22. A computer-readable medium having instructions stored thereon, the instructions performing the function of:

detecting a position in real space of a prescribed part of an observer of virtual images;

outputting spatial coordinates of the position;

determining, on the basis of said spatial coordinates, display positions in real space of said virtual images, wherein the virtual images interact with and are controlled by the prescribed part; and displaying the images on a screen surrounding a game space such that the observer perceives the images three-dimensionally.

23. The computer-readable medium of claim 22, further performing the function of perceiving said virtual images to include images of objects to be fired from the detected position.

24. A computer-readable medium having instructions thereon, the instructions performing the function of:

detecting a position in real space of a prescribed part of the observer of virtual images;

outputting spatial coordinates of the position; and displaying said virtual images, on the basis of said spatial coordinates, such that the virtual images are formed at positions corresponding to said spatial coordinates and the virtual images are displayed on a screen surrounding a game space such that the observer perceives the virtual images three-dimensionally, wherein the virtual images interact with and are controlled by the prescribed part.

25. The computer-readable medium of claim 24, further performing the function of perceiving said virtual images to include images of objects to be fired from the detected position.

26. A three-dimensional imaging system, comprising:

a sensor detecting the viewpoint and viewline of an observer;

a position device detecting the position, in real space, of a prescribed part of the body of said observer; and an image display controlling device displaying a first virtual three-dimensional image, accounting for parallax in the eyes of said observer, in accordance with the viewpoint and viewline detected by said sensor, displaying a second virtual three-dimensional image, accounting for parallax in the eyes of the observer, in correspondence with the position of a part of the body of said observer detected by said position device, and displaying the virtual images on a screen surrounding a game space such that the observer perceives the virtual images three-dimensionally, wherein the first virtual three-dimensional image interacts with and is controlled by the prescribed part.

27. The three-dimensional image system according to claim 26 further comprising an impact detecting device detecting an impact occurring between said first virtual image and said second virtual image, wherein said image display controlling device changes said first virtual image or said second virtual image when an impact is detected by said impact detecting device.

28. The three-dimensional imaging system according to claim 27, wherein said impact detecting device detects whether there is any overlapping between one or more spatial regions having a prescribed radius set by said first virtual image, and one or more spatial regions having a prescribed radius set by said second virtual image, on the basis of the position detected by said position detecting device and said radii.

29. The three-dimensional imaging system according to claim 26, wherein said image display controlling device alternately switches and displays in time divisions images corresponding to a left eye viewpoint, and images corresponding to a right eye viewpoint, and said three-dimensional imaging system further comprising electronic shutters, provided in front of the eyes of said observer, opening and closing in synchronization with the switching of image displays of said image display controlling device.

30. The three-dimensional imaging system according to claim 26, wherein said image display controlling device forms a plurality of left eye images corresponding to left eye viewpoints of a plurality of observers, and a plurality of right eye images corresponding to right eye viewpoints of said plurality of observers, and alternately displays said plurality of left eye images in a series, then alternately displays said plurality of right eye images in a series, and said three-dimensional imaging system further comprising a plurality of electric shutters, provided in front of the eyes of said plurality of observers, opening and closing in accordance with the switching of plurality of images of said image display controlling device.

* * * * *